United States Patent [19]

Bergfelder

[11] Patent Number: 4,919,572

[45] Date of Patent: Apr. 24, 1990

[54] FENDER PILE

[75] Inventor: Jurgen Bergfelder, Cologne, Fed. Rep. of Germany

[73] Assignee: Strabag Bau-AG, Koln-Deutz, Fed. Rep. of Germany

[21] Appl. No.: 243,408

[22] Filed: Sep. 12, 1988

[30] Foreign Application Priority Data

Sep. 17, 1987 [DE] Fed. Rep. of Germany ..... 3731262

[51] Int. Cl.[5] ..... E02B 3/22

[52] U.S. Cl. ..... 405/212; 405/256; 52/230; 52/659; 428/295

[58] Field of Search ..... 405/211, 212, 275, 279; 52/230, 659; 428/292, 295

[56] References Cited

U.S. PATENT DOCUMENTS

| | | | |
|---|---|---|---|
| H402 | 1/1988 | Julian et al. | 405/212 |
| 1,393,545 | 10/1921 | Knuth | 405/275 X |
| 2,115,667 | 4/1938 | Ellis | 404/70 |
| 2,425,883 | 8/1947 | Jackson | 52/544 |
| 3,896,253 | 7/1975 | Elmer | 428/295 X |
| 3,953,648 | 4/1976 | Marzocschi | 428/295 X |
| 3,973,071 | 8/1976 | Fahey | 428/292 |
| 4,217,158 | 8/1980 | Puch | 156/156 |
| 4,266,885 | 5/1981 | Naito et al. | 405/109 |
| 4,627,998 | 12/1986 | Akihama et al. | 52/659 X |
| 4,630,963 | 12/1986 | Wyman | 405/264 X |

OTHER PUBLICATIONS

Mark's Handbook for Mechanical Engineer's, 8th edition, McGraw Hill, 1978.

"Prestressed Concrete Fender Piles", Concrete International, pp. 32–36, by Zinserling et al., May 1987.

*Primary Examiner*—Dennis L. Taylor
*Assistant Examiner*—Arlen L. Olsen
*Attorney, Agent, or Firm*—Body, Vickers & Daniels

[57] ABSTRACT

Concrete fender pile having prestressing members (19, 20) of elongated, high-strength fiber composite elements (21) with a low modulus of elasticity which, during a ramming impact (p), permit a large elastic deflection of the fender pile (14) and are insensitive to aggressive environmental effects.

4 Claims, 1 Drawing Sheet

FENDER PILE

The invention relates to a concrete fender pile having prestressing members extending in the longitudinal direction of the pile.

BACKGROUND OF THE INVENTION

Fender piles have the task of elastically absorbing the ramming impact of a ship during berthing and of protecting from damage the ship's hull on the one hand and the quays or other harbour structures on the other hand. It is therefore essential for a fender pile to be elastic on the one hand but to also have sufficiently high strength on the other hand in order to resist the ramming impact.

Apart from the wooden or steel fender piles known from time immemorial, there are also concrete fender piles which are prestressed in their longitudinal direction with steel prestressing members (journal "Concrete International", May 1987, pp. 32–36). Although these known concrete piles fulfill their purpose, they only have a low durability, since the prestressing members, in particular when the fender piles are used in sea ports, are subjected to very severe corrosion due to the effects of the atmosphere and sea water. Since the fender piles are intended to deform during the ramming impact, cracks inevitably occur in the concrete through which water and air and also aggressive gases present herein can reach the prestressing steel members and quickly destroy them. In addition, since the elasticity of the prestressing members made of high-strength steels is limited, the deformation of the pipes under the ramming impact is relatively slight so that the fender piles themselves must have a relatively high strength, in order to be able to absorb the ramming impacts acting on them.

SUMMARY OF THE INVENTION

The object of the invention is to create a precast concrete fender pile which has a high elasticity and can absorb heavy ramming impacts, and is virtually insensitive to the effects of the atmosphere and aggressive water and can be manufactured inexpensively.

This object is achieved by the invention when the prestressing members consist of elongated, high-strength fibre composite elements with a low modulus of elasticity.

"Fibre composite elements" are understood as bars or strands of fibre composite materials which can be combined to form bundles which form the prestressing members and are either embedded directly in the concrete or are guided in encasing tubes which, after the prestressing of the fibre composite elements, can be pressed out with concrete mortar or another hardening mass.

The prestressing members of fibre composite elements are insensitive to corrosion and, at a high tensile strength, have a substantially higher extensibility than steel. A fender pile reinforced with prestressing members of fibre composite elements can therefore deform to a considerable extent without fracture when an impact strikes it and can absorb considerable energy due to the large deformation displacement. During this deformation, cracks certainly occur in the concrete of the pile which close again after the pile springs back again; however, there is no risk of corrosion, since the fibre composite elements are insensitive to the weather and are not subject to corrosion.

The fibre composite elements can consist of glass fibres or other high-strength fibres which have a low modulus of elasticity and are embedded in a plastic matrix. Here, the glass fibres are preferably endless, thin, unidirectional glass fibres which are combined to form bundles.

It is especially convenient when the prestressing members arranged in the compression zone of the pile crosssection subjected to bending stress during the ramming impact, for producing the longitudinal prestress of the pile, are prestressed approximately up to their full permissible tensile stress, but the prestressing members arranged in the tensile zone of the pile cross-section are prestressed only up to a portion of their permissible tensile stress. For the ramming impact, the fender pile then has a high extensibility in the tensile zone, while in the compression zone, where of course extension does not occur, only a very few fibre composite elements are present as prestressing members, in which, however, the prestress is fully utilized.

The fender pile according to the invention conveniently has a T-shaped cross-section and is arranged in such a way that the compression zone lies in the area of the flange and the tensile zone lies in the area of the web. The highly stressed compression cross-section of the concrete is thereby increased, while the tensile zone, in which the bending tensile forces during a ramming impact are absorbed anyway by the fibre composite elements, can be kept small. In addition, an unsymmetrical cross-section of this type facilitates installation, since the compression and tensile zones of the pile, which are reinforced differently, cannot be confused.

The longitudinal prestress of the precast concrete pile only needs to be so large that it corresponds to the pile strength required for installation. It is approximately of the order of magnitude of 3 $MN/m^2$.

As shear reinforcement, steel stirrups can be provided which are usefully provided with a plastic coating at least in the area of the greatest stress in order to reduce the risk of corrosion.

The pile can consist of cement concrete, the aim being to achieve at least the strength values of a concrete of concrete grade B 55. These concrete grades can be reliably achieved when produced by factory precasting.

When using the fender pile in aggressive waters or in hydraulic engineering in a sea-water environment, it can also be convenient to use a polymer concrete, which, in addition, has good damping properties.

Finally, it is also possible to manufacture the fender pile from a bitumen-bonded concrete. To improve the adhesion and/or toughness, suitable plastics can be added to all concretes, as is known per se in constructional engineering, hydraulic engineering and highway engineering.

BRIEF DESCRIPTION OF THE DRAWINGS

Further features and advantages of the invention follow from the description below and the drawing, in which a preferred exemplary embodiment of the invention is described in greater detail with reference to an example and in which.

DESCRIPTION OF THE PREFERRED EMBODIMENT

Figure 1:
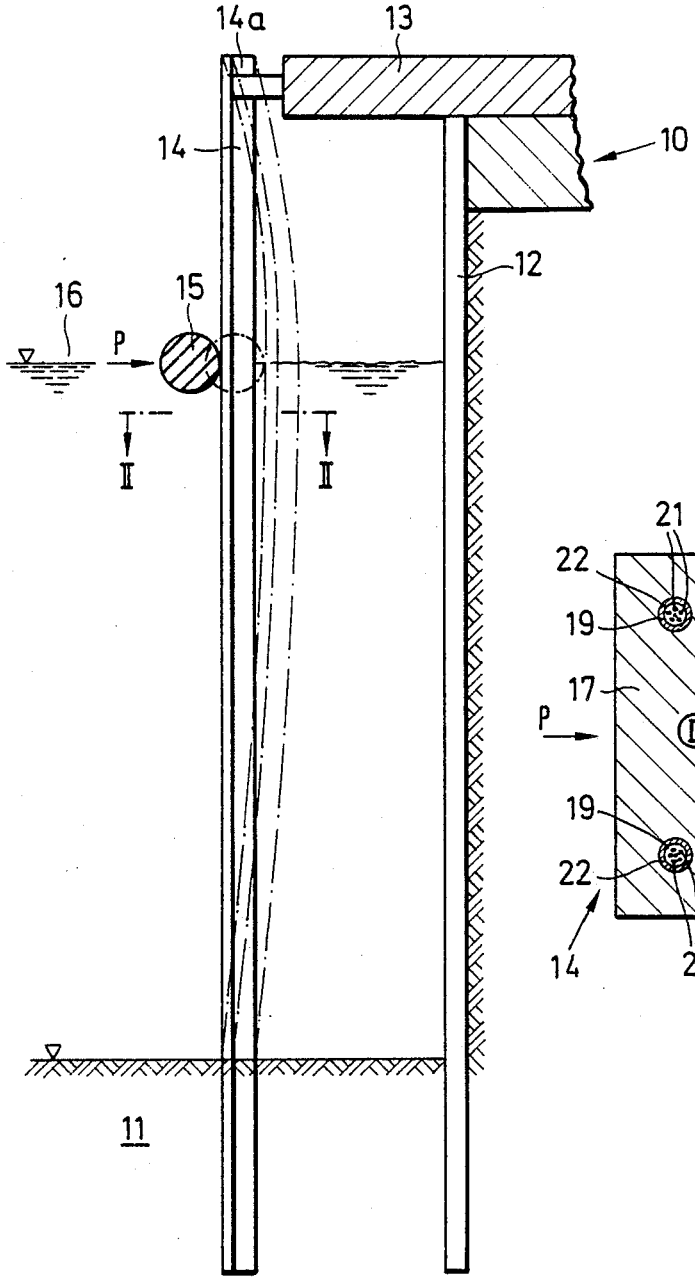
FIG. 1 shows a harbour quay having fender piles, placed in front of it, according to the invention in a partial vertical section.

Rammed in front of a harbour quay 10, which for example consists of steel sheet piling 12 rammed into the river bottom 11 and a pier plate 13 protruding beyond this steel sheet piling 12, is a row of fender piles 14 which, at their head 14*a*, are fixed in an articulated manner to the pier plate 13 and can also be connected to one another. Lying in front of the fender piles 14 is a floating fender 15 of an elastic material which extends over a plurality of fender piles and, when the water level 16 rises and falls, slides up and down in front of the fender piles 14. This floating fender 15 holds a ship (not shown) at a distance from the fender piles 14 when the ship is berthing and transmits its ramming impact P to the fender piles, which in this event deflect elastically to the rear and reach the position shown in chain-dotted lines, absorbing the impact energy while doing so. After the ramming impact, the fender piles 14 spring back into their initial position.

Figure 2:
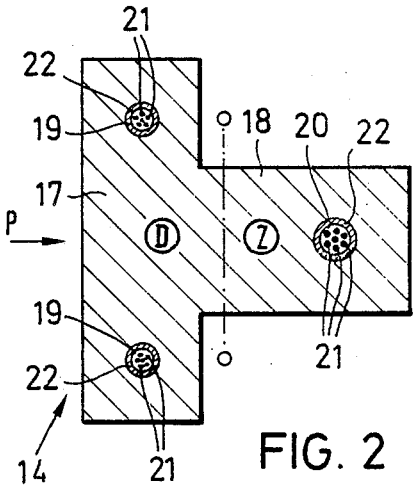
FIG. 2 shows one of the fender piles in a horizontal cross-section of FIG. 1 to an enlarged scale.

As revealed in particular by FIG. 2, each fender pile is made of concrete, in the exemplary embodiment shown a plastic-modified cement concrete of concrete grade B 55, and has a T-shaped cross-section. The fender piles 14 are arranged in front of the structure 10 to be protected in such a way that their flanges 17 are on the outside and the ramming impact P strikes them, while the webs 18 of the fender piles 14 are located on the rear side remote from the impact.

Each fender pile is reinforced with three prestressing members 19 and 20 which extend in the longitudinal direction of the pile 14 and each of which consists of a plurality of fibre composite elements 21 which are combined to form a bundle and are surrounded by an encasing tube 22 which, after the stressing of the particular prestressing member, is injected with a cement mortar or another hardening mass.

It can be recognized from FIG. 1 that each fender pile 14, during a ramming impact P, is subjected to bending stress in such a way that the compression zone resulting at the same time lies on this side of the zero line 0-0 in the area of the flange 17 and the resulting tensile zone Z lies on the other side of the zero line 0-0 in the area of the web 18. The two prestressing members 19 in the area of the compression zone D have a substantially smaller cross-section than the prestressing member 20 in the area of the tensile zone Z but are prestressed up to their full permissible tensile stress. However, the prestressing member 20 arranged in the tensile zone Z and much larger in cross-section is prestressed only up to a portion of its permissible tensile stress so that it can extend considerably under load when the ramming impact P acts on the fender pile and the latter is deflected to the rear as a result.

Since the precast concrete pile only has to be prestressed to the extent that it reaches the strength necessary for the ramming process and no tensile forces originating from the impact of the ship have to be absorbed in the flange 17, the prestressing members arranged in the flange 17 can have a very small cross-section since their prestress can of course also be fully utilized. Together with the T-shape, this results in a very favourable and economical composite cross-section for the fender pile, which, on account of its insensitivity to aggressive environmental effects, also has high durability.

Although, in the fender pile according to the invention, untensioned longitudinal reinforcement can be completely dispensed with, it can be convenient to provide, as shear reinforcement, steel stirrups, which, however, are then provided with a plastic coating, at least in the area of greatest stress.

It will be recognized that the fender pile according to the invention can be made not only of cement concrete but also of other concretes, for example a polymer concrete or a bitumen concrete, it being possible to add to the bitumen or asphalt concrete plastics for improving the adhesion and/or the toughness.

Polymer concretes, in which the mixed-grain aggregates have bonding means consisting of a hardening polymer plastic, has good damping properties and has a good affinity with the fibre composite materials of the prestressing bars, so that special shielding measures are not necessary here.

The invention is not restricted to the exemplary embodiments shown and described; on the contrary, a plurality of modifications and additions are possible without leaving the scope of the invention. For example, the fender pile could also have another cross-section, in the simplest case a rectangular cross-section, and it is also possible to symmetrically reinforce the fender pile.

The fender pile need not necessarily be supported with its head 14*a* against a quay wall structure but can also simply be fixed to the bed 11 of the watercourse. It is also not absolutely necessary to provide a floating fender 15.

I claim:

1. A prestressed concrete fender pile comprising: an elongated concrete pile member having a T-shaped cross section including a flange and a web; prestressing members comprising a plurality of embedded, elongated, prestressed glass fiber composite elements extending longitudinally within said pile member, said member including a first set of said elements arranged within said flange and prestressed to a degree closely approaching their elastic tensile limit, and a second set arranged within said web and prestressed substantially less than said degree of prestressing of said first set.

2. A concrete fender pile having a T-shaped cross section with a flange and a web; and prestressing members comprised of glass fibers embedded in a plastic matrix, said prestressing member extending longitudinally of said pile and including a first set in said flange and a second set in said web, said first set of said prestressing members being prestressed to a degree closely approaching their full permissible tensile stress, and said second set of said prestressing members being prestressed substantially less than said degree of prestressing of said first set.

3. A prestressed concrete fender pile comprising: an elongated concrete pile member having a first cross sectional region and a second cross sectional region; a plurality of elongated prestressed members, extending longitudinally of said pile member and being comprised of glass fibers embedded in a plastic matrix, said prestressing members including a first set of said members associated with said first region and prestressed to a degree closely approaching their elastic tensile limit, and a second set associated with said second region and prestressed substantially less than said degree of prestressing of said first set; said pile member having a T-shaped cross section with a web and a flange, with said first region corresponding with said flange and said second region distinctly corresponding with said web.

4. A concrete fender pile having prestressing members extending in a longitudinal direction of the pile, said prestressing members being comprised of glass fibers embedded in a plastic matrix; said pile having a first cross sectional region including a first set of said prestressing and a distinct second cross sectional region including a distinct second set of said prestressing members; said first set of prestressing members being prestressed to a degree closely approaching their full permissible elastic tensile limit and said second set of prestressing members being prestressed substantially less than said degree of prestressing of said first set.

* * * * *